US006044746A

United States Patent [19]

Gendre et al.

[11] Patent Number: 6,044,746

[45] Date of Patent: Apr. 4, 2000

[54] PROJECTILE PROPULSION ASSEMBLY THAT LIMITS RECOIL FORCE

[75] Inventors: Pascal Gendre; Gregory Soulier, both of Toulouse; Régis Riffet, Roquettes, all of France

[73] Assignee: Etienne Lacroix Trous Artifices S.A., Muret, France

[21] Appl. No.: 09/095,645

[22] Filed: Jun. 11, 1998

[30] Foreign Application Priority Data

Jun. 11, 1997 [FR] France ..... 97 07226

[51] Int. Cl.[7] ..... F41F 3/04

[52] U.S. Cl. ..... 89/1.816; 89/1.703

[58] Field of Search ..... 89/1.816, 1.7, 89/1.703, 1.3, 14.05; 102/430, 439, 443, 51

[56] References Cited

U.S. PATENT DOCUMENTS

| | | | |
|---|---|---|---|
| 1,347,125 | 7/1920 | Schneider | 89/1.3 |
| 2,651,972 | 9/1953 | Engelke | 89/1.7 |
| 3,134,330 | 5/1964 | Batou | 102/376 |
| 3,138,991 | 6/1964 | Malter | 89/14.3 |
| 3,376,784 | 4/1968 | Abramson | 89/1.703 |
| 3,380,340 | 4/1968 | Bergman et al. | 89/1.703 |
| 3,505,924 | 4/1970 | Driscoll | 89/1.3 |
| 3,628,415 | 12/1971 | McElroy | 89/1 F |
| 4,038,902 | 8/1977 | Welsh | 89/1.807 |
| 4,782,758 | 11/1988 | Washburn | 102/434 |
| 4,803,927 | 2/1989 | Washburn | 102/434 |
| 4,962,689 | 10/1990 | Phan et al. | 89/1.703 |
| 5,289,776 | 3/1994 | Thiesen et al. | 102/431 |
| 5,837,919 | 11/1998 | Yagla et al. | 89/1.816 |

FOREIGN PATENT DOCUMENTS

| | | | |
|---|---|---|---|
| 0090155 | 5/1983 | European Pat. Off. . | |
| 3336295 | 4/1985 | Germany . | |
| 2 713 324 A1 | 11/1993 | Germany . | |
| 484346 | 5/1938 | United Kingdom . | |
| 592092 | 9/1947 | United Kingdom | 89/1.7 |
| WO 91/07636 | 5/1991 | WIPO . | |

OTHER PUBLICATIONS

Navy Techn. Disclos. Bull., vol. III, No. 3, Mar. 1978[1].

*Primary Examiner*—Charles T. Jordan
*Assistant Examiner*—Jeffrey Howell
*Attorney, Agent, or Firm*—Jacobson, Price, Holman & Stern, PLLC

[57] ABSTRACT

The present invention relates to a projectile propulsion assembly of the type comprising a chamber housing a pressure source. The chamber which houses the pressure source communicates with at least one pipe placed inside the launch tube and having bores distributed along its length so as to be released in succession during ejection of the projectile.

27 Claims, 2 Drawing Sheets

PROJECTILE PROPULSION ASSEMBLY THAT LIMITS RECOIL FORCE

FIELD OF THE INVENTION

The present invention relates to the field of projectile propulsion assemblies, and particularly to the field of projectile launcher tube systems.

The present invention relates particularly, but not exclusively, to weapons. Nevertheless it is not limited to this preferred application, and it can be used in any projectile launcher, e.g. launcher tubes for fireworks, alarm signals, antihail rockets, and indeed launcher tubes on test beds where the projectiles can be constituted by carriages or the equivalent, for example, in particular for impact testing, etc.

BACKGROUND OF THE INVENTION

Most known projectile launcher tube systems comprise, as shown in accompanying FIG. 1, a barrel tube 10, a breech or end wall 12 closing the tube 10 at one end, and a pressure source 14 which is generally constituted by a pyrotechnical cartridge.

Before firing, the projectile 20 defines a chamber 16 inside the tube 10, which chamber contains the pyrotechnical cartridge 14.

On firing, explosion of the pyrotechnical cartridge 14 generates driving pressure on the projectile 20 inside said chamber 16. The projectile is set into motion, and the increase in the volume of the chamber 16 causes the gases to expand until the chamber 16 is put into communication with the atmosphere when the projectile 20 leaves the barrel tube 10, as shown diagrammatically in FIG. 2. Over this duration, the integral of pressure multiplied by the sectional area of the barrel tube 10 gives the impulse imparted to the shot.

Such known launch tubes present the drawbacks firstly of generating a large amount of recoil force that is felt by the person firing or by the support of the launch tube, and secondly requires the wall thickness of the tube to be considerable, because of the pressure peak that is generated immediately after the cartridge 14 has exploded. This peak is particularly troublesome for weapons that are fired from the shoulder.

Attempts have already been made to limit the peak recoil force that results from the pressure peak by placing damper means between the launch tube and a reference, e.g. a shoulder piece, or a carriage supporting the launch tube.

Also, in document FR-A-2 713 324, the Applicant has proposed a projectile propulsion assembly of the type comprising a chamber housing a pressure source and communicating with an expansion volume via a passage that is controlled by a servo-control valve enabling the projectile driving pressure to be controlled and preferably adapted to define constant pressure in the expansion chamber.

Document WO-A-91/07636 describes a projectile that includes means for timed ejection of a charge. More precisely, that document describes a launcher comprising a pressure source (not shown) for launching a projectile. The projectile comprises a payload, a first pressure chamber, and a second pressure chamber. A valve feeds the first pressure chamber from the source. The first pressure chamber also communicates with the second pressure chamber via a calibrated orifice. More precisely, the second chamber is defined between a piston that can thrust against the payload and a case defining the first chamber, the piston and the case being interconnected by a shear pin. In addition, according to an essential characteristic of that document, the first chamber is filled with a fibrous material. That projectile operates essentially as follows. During launching, the first chamber is charged at constant pressure via the valve. The pressure in the second chamber rises progressively until the pin shears. The piston then expels the payload with a sudden increase of pressure in the second chamber via the passage thus released by the link between the two pressure chambers.

Document Navy Techn. Disclos. Bull., Vol. III, No. Mar. 3, 1978, Dahlgren Virginia describes a propellant provided on a launch system or on a projectile. That document relates essentially to means for adjusting an area ratio between vents and an orifice leading to the expansion chamber.

Document U.S. Pat. No. 3,628,415 discloses a mortar. It essentially describes means for adjusting the free section of a vent passage. A valve formed by a flap cooperating with the passage serves to evacuate residual moisture from inside the mortar.

Document GB-A-484 346 describes a cartridge containing projectile guide means in the form of a central internal tube. A fraction of the propellant charge is placed inside said tube forming guide means for the projectile and another portion of the propellant charge is disposed outside said guide tube. In this way, in order to guarantee simultaneous initiation of both portions of the propellant charge and also to guarantee equal pressures inside and outside the guide tube, the tube is perforated. Nevertheless, the disposition described in that document does not make it possible in any way to control propulsion pressure, and in particular to maintain it at a value that is at least substantially constant.

OBJECTS AND SUMMARY OF THE INVENTION

The present invention seeks to improve known projectile propulsion systems for the purpose or improving the performance thereof.

A main aim of the present invention is to modify the internal ballistics of a launch tube so that the pressure inside the tube during firing is as constant as possible.

In the context of the present invention, these objects are achieved by a projectile propulsion assembly of the type comprising a chamber housing a pressure source, wherein said chamber which houses the pressure source communicates with at least one pipe placed inside the launch tube and having bores distributed along its length so as to be released in succession during ejection of the projectile.

According to another advantageous characteristic of the invention, the bores formed through the pipe are organized specifically with respect to distribution, size, and number, in such a manner as to be adapted to ensuring propulsion pressure that is at least substantially constant inside the launch tube.

According to another advantageous characteristic of the invention, the wall of the pipe provided with the bores is interposed between the chamber housing the pressure source and the expansion chamber that propels the projectile.

The present invention also relates to projectiles suitable for being fired from such a propulsion assembly.

BRIEF DESCRIPTION OF THE DRAWINGS

Other characteristics, objects, and advantages of the present invention will appear on reading the following detailed description and from the accompanying drawings, given as non-limiting examples, and in which.

MORE DETAILED DESCRIPTION

Figure 1:
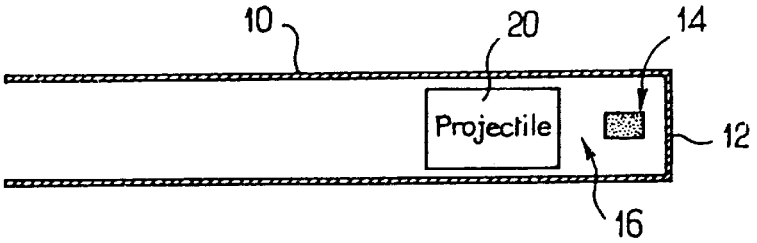
FIG 1 PRIOR ART
FIG. 1, as described above, is a diagrammatic view in axial section of a conventional launcher tube.
Figure 2:
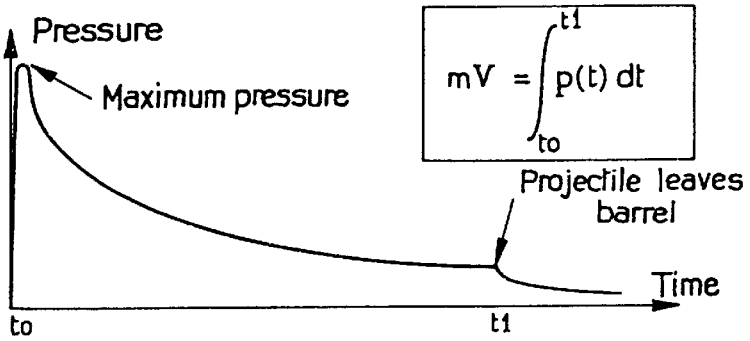
FIG. 2, as mentioned above, shows the driving impulse in such a conventional launcher tube.

The propulsion assembly of the present invention comprises a launch tube 100.

The launch tube 100 constitutes a closed barrel, i.e. its rear end is closed by a breech 110 or the equivalent.

The launch tube receives a pressure source 120. The pressure source is preferably a pyrotechnical cartridge, however the pressure source 120 may be formed by any equivalent means.

The tube 100 is adapted to receive a projectile 200. The projectile is adapted to the internal calibre of the tube 100, as can be seen in the accompanying figures.

As mentioned above, in the context of the present invention, the chamber housing the pressure source 120 communicates with a pipe 130 placed inside the launch tube 100. The pipe 130 has bores 132 distributed along its length to be released successively during ejection of the projectile 200.

Most preferably, a single pipe 130 is provided centered on the axis O—O of the tube 100. Nevertheless, where appropriate, it is possible to provide a plurality of pipes 130 uniformly distributed around the axis O—O.

It will be observed that in the embodiments shown in the accompanying figures, the projectile 200 is provided with a chamber 210 that is open at its rear end, which chamber 210 is matched to the outside diameter of the pipe 130. In this way, the projectile 200 originally covers most of the bores 132, but releases them progressively as it is displaced.

The tube 100 and the projectile 200 can be implemented in numerous different ways. They are therefore not described in detail below.

Figure 3:
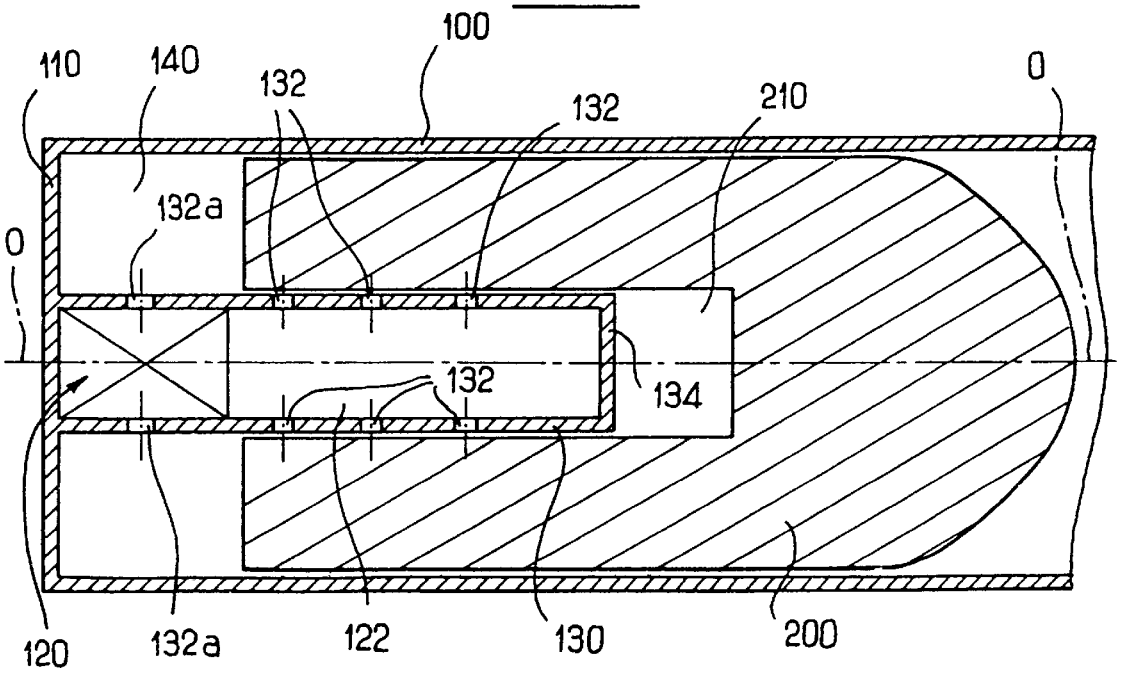
FIG. 3 is a diagrammatic longitudinal section view through a device constituting a first embodiment of the present invention, shown prior to launch.

Nevertheless, it will be observed that in the embodiment shown in FIG. 3, the pressure source or pyrotechnical cartridge 120 is placed directly inside the pipe 130 so that the chamber 122 which houses the pressure source 120 communicates directly via the bores 132 with the chamber 140 which receives the projectile 200.

Figure 4A:
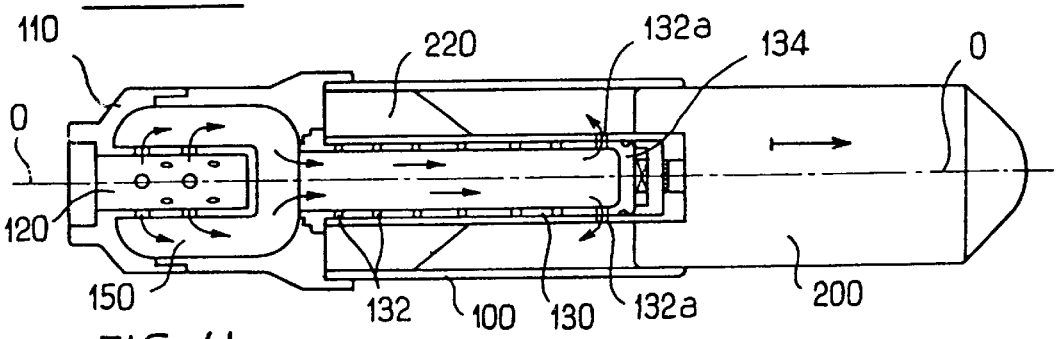
FIGS. 4*a*, 4*b*, and 4*c* are similar views of a device constituting a second embodiment of the present invention, at three successive stages during launching of a projectile.
Figure 4B:
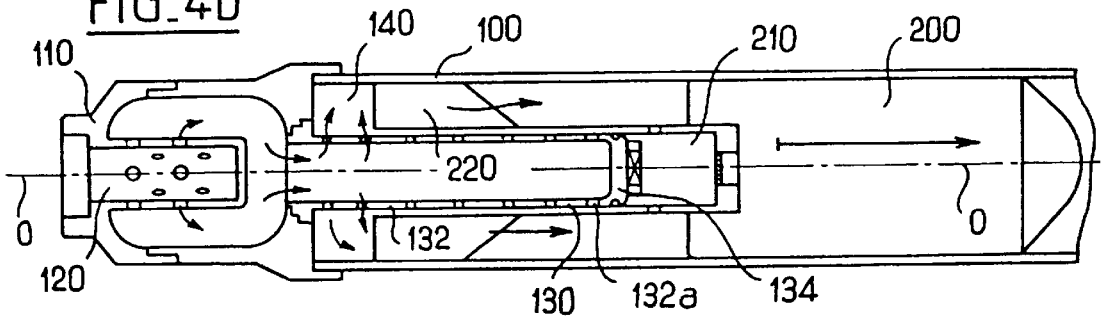
Figure 4C:
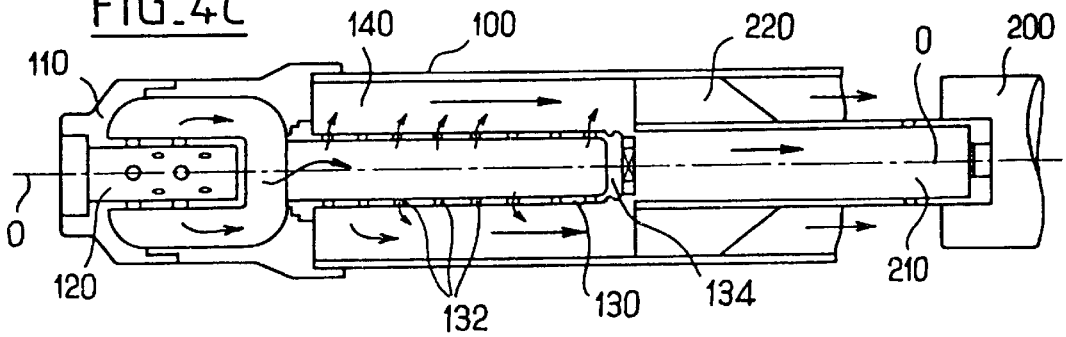

In contrast, in the embodiment shown in FIGS. 4*a*, 4*b*, and 4*c*, an intermediate chamber 150 is interposed between the very high pressure chamber 122 housing the source 120 and the chamber 140 which receives the projectile 200. The high pressure intermediate chamber 150 communicates with the inside volume of the pipe 130.

Naturally, the pipe 130 is closed at its front end by a transverse partition 134 such that the only communication possible between the inside volume of the pipe 130 and the chamber 140 receiving the projectile 200 corresponds to the bores 132.

When ready to fire, at least one of the orifices 132 formed through the pipe 130 communicates with said chamber 140 that receives the projectile 200 so as to make it possible for high pressure gas to flow from the inside volume of the pipe 130 into said chamber 140. This orifice is given reference 132*a* in the accompanying figures. In FIG. 3, the orifice(s) concerned is/are closest to the breech 110.

However, in FIGS. 4*a* to 4*c*, the orifice(s) 132 opening out initially into the chamber 140 is/are the foremost orifice(s), i.e. closest to the wall 134 (in FIGS. 4*a* to 4*c*, said orifice 132*a* is subsequently temporarily closed by the projectile 200 once firing has started, and prior to the projectile 200 leaving the tube 100).

Before firing, the projectile 200 can be held inside the tube 100 by any appropriate conventional means, e.g. by shear pins.

In the embodiment shown in FIGS. 4*a* to 4*c*, the projectile 200 is provided with tail fins 220 at its rear end.

The tail fins 220 are adapted initially to close all of the orifices 132 through the pipe with the sole exception of the above-mentioned orifice 132*a*.

As mentioned above, in the context of the present invention, the organization of the orifices 132, and in particular the distribution, the size, and the number thereof, is adapted to ensure that the propulsion pressure inside the propulsion chamber 140 remains at least substantially constant.

For this purpose, as can be seen in the accompanying figures, the wall of the pipe 130 perforated by the orifices 132 is interposed directly or indirectly (via the high pressure chamber 150) between the chamber housing the pressure source 120 and the propulsion chamber 140.

The propulsion assembly of the present invention operates essentially in three successive stages.

Figure 5:
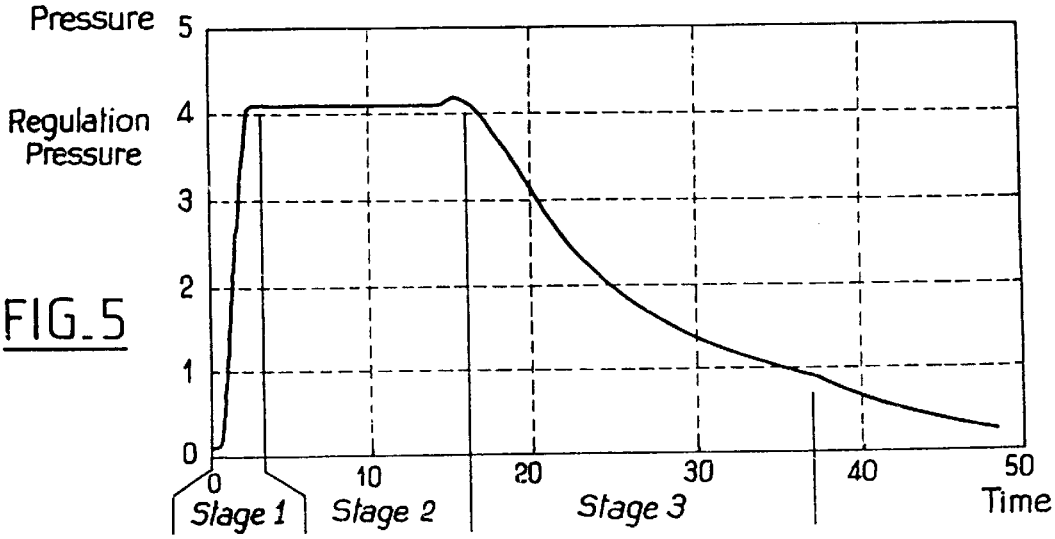
FIG. 5 is a graph showing pressure inside the launch tube of the invention as a function of time.

The pressure which obtains inside the launch tube 100 during these three successive stages is shown by way of non-limiting example in FIG. 5.

On firing, the pyrotechnical cartridge 120 (or equivalent pressure source, e.g. constituted by a source of compressed gas) generates very high pressure gas filling the pipe 130 (directly in FIG. 3, and after passing via the chamber 150 in FIG. 4) and flowing into the chamber 140 via the bore(s) 132*a*. After flowing in this way via the bore 132*a*, the driving pressure increases inside the chamber 140 during a stage referenced "stage 1" in FIG. 5 until it reaches a regulation pressure at the end of said stage 1. The projectile 200 moves along the tube 100 as said driving pressure increases.

Preferably, in the second embodiment as shown in FIGS. 4*a* to 4*c*, because of the displacement of the projectile 200 during this stage 1, the initial flow section 132*a* is fully closed at the end of said stage 1, however the rear bores 132 are by then uncovered.

During the second stage as shown in FIG. 5, displacement of the projectile 200 progressively unmasks the bores 132 formed through the pipe 130 to maintain the driving pressure inside the chamber 140 at a substantially constant level. The progressive release of the bores 132 makes it possible to increase the flow rate of fluid from the pressure source 120 to the launch chamber 140 so as to maintain the driving pressure at a value that is at least substantially constant.

A third stage begins when the projectile 200 has unmasked all of the orifices 132. The driving pressure can then no longer be maintained at a constant regulation threshold. This is when a low pressure expansion stage begins, as shown in FIG. 5.

In FIGS. 4*a*, 4*b*, and 4*c*, the projectile 200 is shown respectively in the positions it occupies in stage 1, stage 2, and stage 3 of FIG. 5.

Naturally, the number, the size, and the positions of the bores 132 must be adapted as a function of the power of the pressure source 120, and as a function of the calibre and the mass of the projectile 200.

By way of non-limiting example, for a projectile 200 of 3" calibre (7.62 cm), the length of the pipe 130 is 120 mm and its diameter is 26 mm. The pipe is provided with 24 bores 132 each constituted by a circular orifice having a diameter of about 2 mm, with the bores being distributed at a pitch lying in the range 21 mm to 12 mm over the length of the pipe 130, and the pipe is also provided with three holes 132*a* each having a diameter of about 1.5 mm.

Naturally, the propulsion device of the present invention can be combined with any other known such structure capable of producing the recoil force on the tube 100, e.g. any damper means compatible with said propulsion device.

The present invention is particularly applicable to weapons systems for firing from the shoulder.

The present invention provides numerous advantages over previously known systems.

By way of non-limiting example, the following may be mentioned:

a reduction in the propulsion forces on the projectile 200, thus making it possible to reduce the mass of its structure, or for given projectile mass, to increase the mass of its payload;

a reduction in the recoil stroke of the tube 100 for given impulse and damping force: this minimizes the displacement of the center of gravity of the weapon during firing, and thus the disturbances associated with such movement (aiming noise, rotary movement in a vertical plane of the person firing); this also reduces the length of time that a force is applied to the person firing, thereby making firing less uncomfortable;

a reduction in damping force for given barrel recoil and impulse: this minimizes the force applied to the person firing, thereby making firing less uncomfortable;

an increase in firing impulse for given damping force and recoil stroke of the barrel 100; this increases firing performance for given discomfort on firing; and a reduction in the maximum internal pressure that obtains inside the tube 100, thus making it possible to reduce the wall thickness of the tube 100 and therefore to reduce the weight thereof.

Naturally, the present invention is not limited to the particular embodiments described above, but extends to any variant coming within the spirit of the invention.

In particular, the pipe 130 can be integrated in a non-consumable breech of a barrel or it can be integrated in a consumable cartridge secured to a projectile.

We claim:

1. A projectile propulsion assembly comprising a launch tube including a launch chamber for receiving a projectile and a chamber housing a pressure source, wherein said chamber housing the pressure source communicates with at least one pipe placed inside the launch tube between the chamber housing the pressure source and the launch chamber for receiving the projectile, said pipe having bores distributed along its length so as to be released in succession during ejection of the projectile, and to increase the flow rate of fluid from the pressure source to the launch chamber and to maintain a driving pressure at a value that is at least substantially constant in the launch chamber.

2. An assembly according to claim 1, wherein the bores formed through the pipe are organized specifically with respect to distribution, size, and number, in such a manner as to be adapted to ensuring propulsion pressure that is at least substantially constant inside the launch tube.

3. An assembly according to claim 1, wherein the wall of the pipe provided with the bores is interposed between the chamber housing the pressure source and an expansion chamber that propels the projectile.

4. An assembly according to claim 1, wherein the pipe houses the pressure source.

5. An assembly according to claim 1, wherein an intermediate high pressure chamber is interposed between the chamber which receives the pressure source and the inside volume of the pipe.

6. An assembly according to claim 1, including a projectile provided with a chamber which opens out at its rear surface, which chamber is matched to the outside diameter of the pipe.

7. An assembly according to claim 1, wherein at least one of the bores of the pipe opens out initially freely into the chamber which receives the projectile.

8. An assembly according to claim 7, wherein the bore which opens out initially into the chamber receiving the projectile is the rearmost bore formed in the pipe.

9. An assembly according to claim 7, wherein the bore which opens out initially into the chamber receives the projectile is an orifice which is temporarily closed by the projectile after firing has been initiated, because of the displacement of the projectile.

10. An assembly according to claim 9, wherein the orifice which opens out initially into the chamber receiving the projectile is temporarily closed by the tail fin of the projectile following displacement of the projectile.

11. An assembly according to claim 1, wherein the pipe is centered inside the tube.

12. An assembly according to claim 1, comprising a plurality of pipes provided with bores, the pipes being uniformly distributed about an axis O—O of the tube.

13. An assembly according to claim 1, wherein the pressure source is integrated in the launch tube.

14. An assembly according to claim 1, wherein the pressure source is placed inside a pipe integrated in a non-consumable breech of a barrel.

15. An assembly according to claim 1, wherein the pressure source is placed inside a pipe integrated in a consumable cartridge.

16. A projectile for a propulsion assembly according to claim 1, including a chamber opening out to its rear end and matched to the outside calibre of the pipe.

17. A projectile propulsion assembly comprising a chamber housing a pressure source, wherein said chamber housing the pressure source communicates with at least one pipe placed inside the launch tube and having bores distributed along its length so as to be released in succession during ejection of a projectile, and wherein a wall of the pipe provided with the bores is interposed between the chamber housing the pressure source and an expansion chamber that propels the projectile.

18. A projectile propulsion assembly comprising a chamber housing a pressure source, wherein said chamber housing the pressure source communicates with at least one pipe placed inside the launch tube, having bores distributed along its length so as to be released in succession during ejection of the projectile, and housing the pressure source.

19. A projectile propulsion assembly comprising a chamber housing a pressure source, wherein said chamber housing the pressure source communicates with at least one pipe placed inside the launch tube and having bores distributed along its length so as to be released in succession during ejection of the projectile, said assembly further including a projectile provided with a chamber which opens out at its rear surface, which chamber is matched to the outside diameter of the pipe.

20. A projectile propulsion assembly comprising a chamber housing a pressure source, wherein said chamber housing the pressure source communicates with at least one pipe placed inside a launch tube and having bores distributed along its length so as to be released in succession during ejection of a projectile, and wherein at least one of the bores of the pipe opens out initially freely into the chamber which receives the projectile.

21. An assembly according to claim 20, wherein the bore which opens out initially into the chamber which receives the projectile is the rearmost bore formed in the pipe.

22. An assembly according to claim 20, wherein the bore which opens out initially into the chamber which receives the projectile is an orifice which is temporarily closed by the projectile after firing has been initiated, because of the displacement of the projectile.

23. An assembly according to claim 20, wherein the orifice which opens out initially into the chamber which receives the projectile is temporarily closed by a tail fin of the projectile following displacement of the projectile.

24. A projectile propulsion assembly comprising a chamber housing a pressure source, wherein said chamber housing the pressure source communicates with a plurality of pipes uniformly distributed about an axis O—O of the tube, inside the launch tube and having bores distributed along its length so as to be released in succession during ejection of the projectile.

25. A projectile propulsion assembly comprising a chamber housing a pressure source, wherein said chamber housing the pressure source is placed inside a pipe integrated in a non-consumable breech of a barrel, said pipe having bores distributed along its length so as to be released in succession during ejection of the projectile.

26. A projectile propulsion assembly comprising a chamber housing a pressure source, wherein said chamber housing the pressure source is placed inside a pipe integrated in a consumable cartridge, said pipe having bores distributed along its length so as to be released in succession during ejection of the projectile.

27. A projectile for a propulsion assembly comprising a chamber housing a pressure source, wherein said chamber housing the pressure source communicates with at least one pipe placed inside a launch tube and having bores distributed along its length so as to be released in succession during ejection of the projectile, wherein said projectile includes a chamber opening out to its rear end and matched to the outside caliber of the pipe.

* * * * *

UNITED STATES PATENT AND TRADEMARK OFFICE

CERTIFICATE OF CORRECTION

PATENT NO. : 6,044,746
DATED : April 4, 2000
INVENTOR(S) : Gendre et al.

It is certified that error appears in the above-identified patent and that said Letters Patent is hereby corrected as shown below:

Title page,
Item [73], should read -- [73] Assignee: Etienne Lacroix Tous Artifices S.A., Muret, France --

Signed and Sealed this

Twenty-second Day of October, 2002

*Attest:*

*Attesting Officer*

JAMES E. ROGAN
*Director of the United States Patent and Trademark Office*